United States Patent [19]

Yoshieda et al.

[11] Patent Number: 4,724,990

[45] Date of Patent: Feb. 16, 1988

[54] FASTENER-ASSEMBLING APPARATUS WITH SAFETY DEVICE

[75] Inventors: Keiichi Yoshieda; Yasunari Noda, both of Kurobe, Japan

[73] Assignee: Yoshida Kogyo K. K., Tokyo, Japan

[21] Appl. No.: 896,064

[22] Filed: Aug. 13, 1986

[30] Foreign Application Priority Data

Aug. 16, 1985 [JP] Japan ..... 60-125144[U]

[51] Int. Cl.[4] ..... B21J 15/10

[52] U.S. Cl. ..... 227/8; 227/124; 227/154; 227/15

[58] Field of Search ..... 227/1, 2, 8, 51, 53, 227/55, 124, 151, 154, 155; 29/716, 243.5

[56] References Cited

U.S. PATENT DOCUMENTS

| | | | |
|---|---|---|---|
| 4,343,423 | 8/1982 | Sauermilch | 227/1 |
| 4,378,900 | 4/1983 | Sauermilch | 227/53 |
| 4,485,541 | 12/1984 | Seki | 227/8 |
| 4,598,468 | 7/1986 | Yoshieda | 227/8 |
| 4,606,487 | 8/1986 | Douri | 227/8 |

FOREIGN PATENT DOCUMENTS 0142806 5/1985 European Pat. Off. .

*Primary Examiner*—Paul A. Bell
*Assistant Examiner*—James L. Wolfe
*Attorney, Agent, or Firm*—Hill, Van Santen, Steadman & Simpson

[57] ABSTRACT

A fastener assembling apparatus has a safety device including a vertical elongate rod vertically movably supported by a reciprocable ram and having a feeler disposed adjacent to the path of movement of a punch carried on the ram, the rod being normally urged downwardly toward a lowermost position in which the feeler is disposed adjacent to a die of the apparatus, and an actuator operatively connected with a sensor and a ram-driving mechanism for activating the ram-driving mechanism only when the arrival of the rod at the lowermost position is detected by the sensor, thus avoiding any accident should the operator's finger be inadvertently jammed between the punch and die. A stopper lever is pivotably connected to the rod and normally urged toward a locking position in which the stopper is held in interlocking engagement with an abutment disposed on the ram, the stopper lever being driven by a further actuator to turn to a releasing position in which the stopper lever is disengaged from the abutment, thereby permitting downward movement of the rod.

8 Claims, 4 Drawing Figures

FASTENER-ASSEMBLING APPARATUS WITH SAFETY DEVICE

BACKGROUND OF THE INVENTION

1. Field of the Invention:

The present invention relates to an apparatus for assembling a pair of fastener elements of a garment fastener, such as a snap fastener, a button and an ornament, with a garment fabric disposed between the two fastener elements. More particularly, it relates to such fastener-assembling apparatus including a safety device for securing safety of the operator.

2. Prior Art:

There are known various fastener-assembling apparatus which comprise a reciprocable ram mounted on the upper portion of a frame and carrying thereon a punch for supporting one fastener element of a garment fastener, and a die mounted on a lower portion of the frame for supporting a mating fastener element, the ram being movable toward and away from the die to join the two fastener elements together in clinched condition, with a garment fabric sandwiched between the two fastener elements. With such known apparatus, there would be a danger that an operator's finger would be inadvertently jammed between the punch and die.

SUMMARY OF THE INVENTION

It is accordingly an object of the present invention to provide a fastener-assembling apparatus having a safety device for securing safety of the operator, the safety device being simple in construction and reliable in operation.

According to the present invention, a fastener assembling apparatus has a safety device including a vertical elongate rod vertically movably supported by a reciprocable ram and having a feeler disposed adjacent to the path of movement of a punch carried on the ram, the rod being normally urged downwardly toward a lowermost position in which the feeler is disposed adjacent to a die of the apparatus, and an actuator operatively connected with a sensor and a ram-driving means for activating the ram-driving means only when the arrival of the rod at the lowermost position is detected by the sensor. A stopper lever is pivotably connected to the rod and is normally urged toward a locking position in which the stopper is held in interlocking engagement with an abutment disposed on the ram, the stopper lever being driven by a further actuator to turn to a releasing position in which the stopper lever is disengaged from the abutment, thereby permitting downward movement of the rod. The stopper lever includes a downwardly facing locking nose engageable with an upwardly facing retaining surface of the abutment when the ram is returned from its lowermost clinching position to its uppermost waiting or standby position.

Many other advantages, features and other objects of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 1:
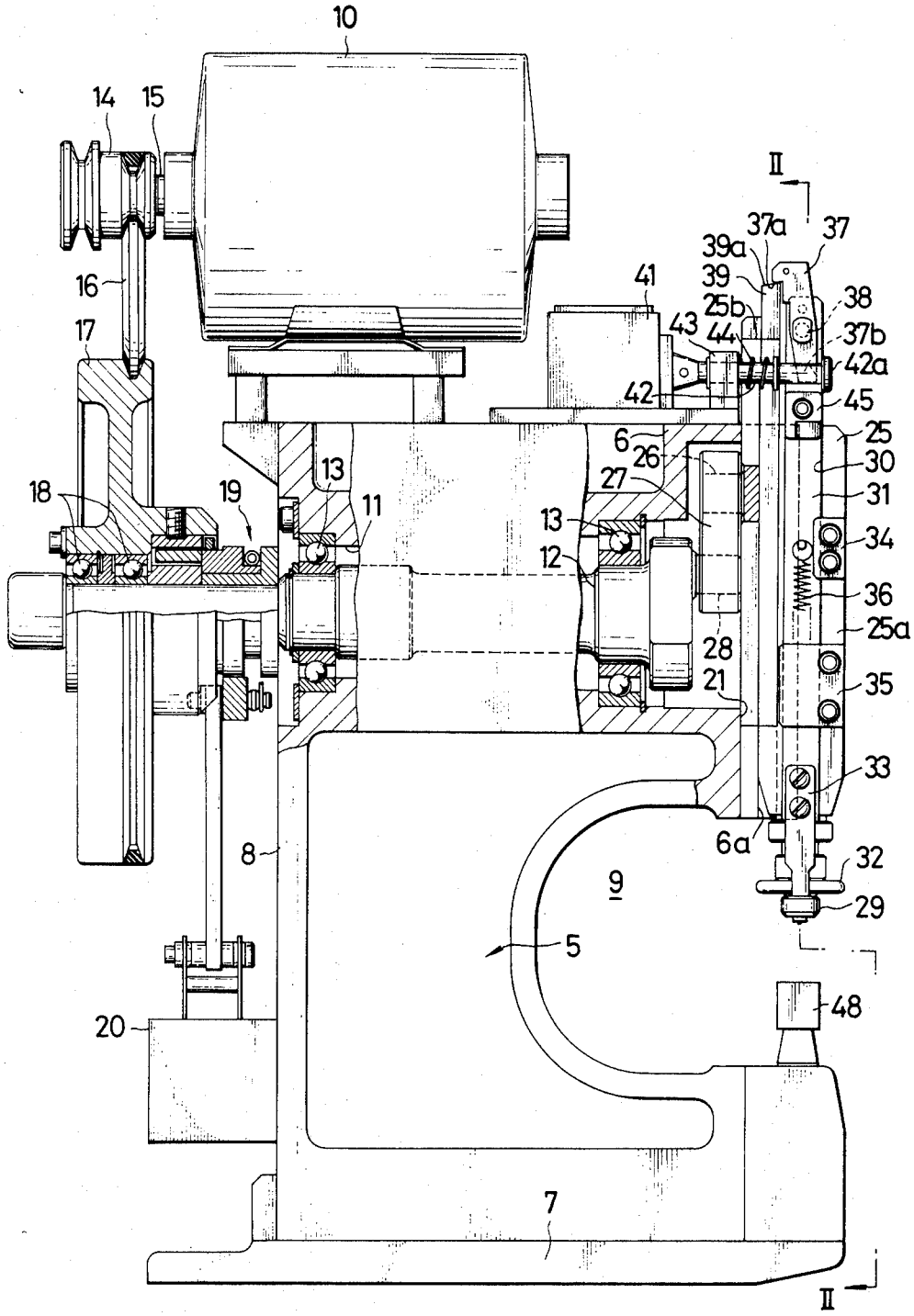
FIG. 1 is a side elevational, partially cross-sectional. view of a fastener assembling apparatus embodying the present invention.

As shown in FIG. 1, a fastener assembling apparatus embodying the present invention includes a generally C-shaped frame 5 having a pair of upper and lower horizontal portions 6, 7 and an intermediate vertical portion 8 interconnecting the upper and lower frame portions 6, 7 with a punch-working space 9 defined therebetween. The upper frame portion 6 supports thereon an electric motor 10 and has, throughout the length thereof, a horizontal bore 11 in which a main shaft 12 is rotatably supported via a pair of roller bearings 13, 13. A primary pulley 14 is secured to a drive shaft 15 of the motor 10 for corotation therewith and is drivingly connected by an endless belt 16 to a secondary pulley 17 which is rotatably mounted on an end portion of the main shaft 12 by means of a pair of roller bearings 18, 18. The secondary pulley 17 has a diameter much larger than the diameter of the primary pulley 14 for multiplying a torque generated by the motor 10. A single revolution clutch 19 is mounted on the main shaft 12 adjacent to the secondary pulley 17 for intermittently connecting the secondary pulley 17 and the main shaft 12. The single revolution clutch 19 is connected in driven relation to a first solenoid 20 and is driven by the latter to engage the pulley 17 with the main shaft 12 when the solenoid 20 is energized.

Figure 2:
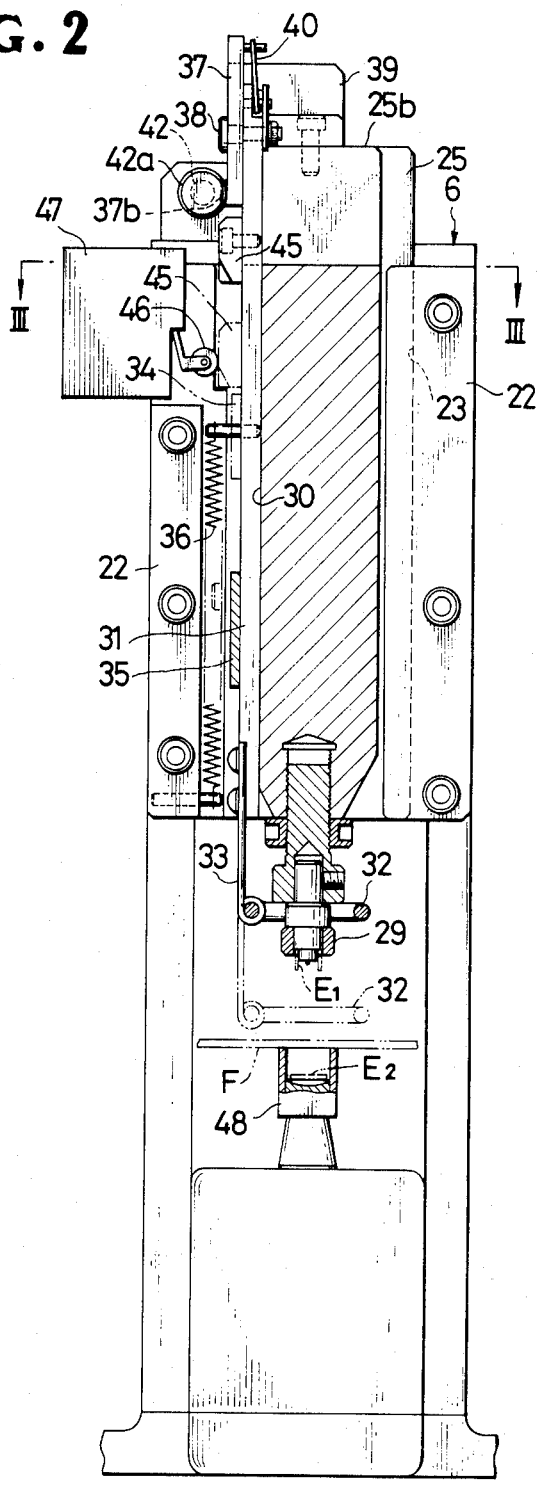
FIG. 2 is an enlarged cross-sectional view taken along line I—II of FIG. 1.
Figure 3:
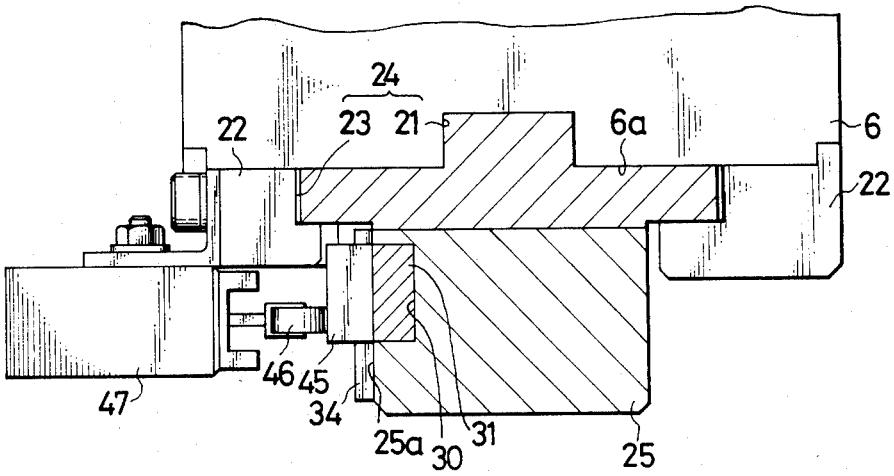
FIG. 3 is an enlarged fragmentary cross-sectional view taken along line III—III of FIG. 2.

The upper frame portion 6 includes a vertical recess 21 extending centrally in a front wall **6*a* of the upper frame portion 6. A pair of L-shaped elongate.ram guides 22, 22 (FIG. 2) is secured to the front wall 6*a*, one on each side of the recess 21 so as to define therebetween a guide groove 23 (FIG. 2). As shown in FIG. 3, the guide groove 23 and the vertical recess 21 communicate with each other to jointly constitute a guide channel 24. A ram 25 is slidably disposed in the guide channel 24 and includes, as shown in FIG. 1, a connecting pin 26 projecting horizontally from a vertical rear wall of the ram 25. The connecting pin 26 is pivotably connected to one end of a link 27, the other end of which is pivotably connected to the main shaft 12 by an eccentric pin 28 projecting from one end of the main shaft 12. With this construction, the ram 25 completes one cycle of vertical reciprocation in response to a single revolution of the main shaft 12. The ram 25 carries on its lower end a punch 29** for supporting thereon a fastener element $E_1$.

The ram 25 includes, in its side wall **25*a*, a vertical guide groove 30 extending throughout the length of the ram 25 for slidably receiving therein an elongate rod 31, the rod 31 constituting a part of a safety device. The rod 31 includes a ring-like feeler 32 connected to a lower end of the rod 31 by a connecting plate 33. The ring-like feeler 32 extends loosely around the punch 29 when the ram 25** is held in its uppermost waiting or standby position.

Figure 4:
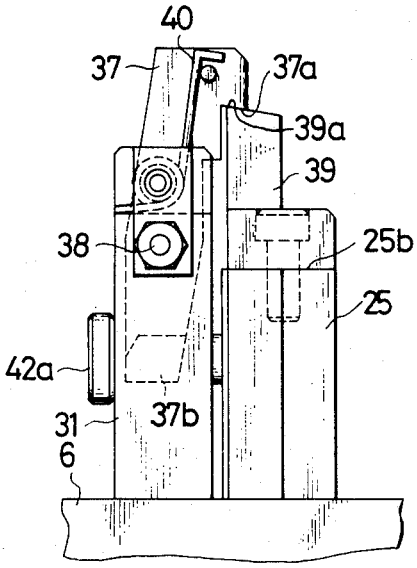
FIG. 4 is a right side elevational view of FIG. 3, showing an upper part of the apparatus.

A pair of upper and lower guide blocks 34, 35 is secured to the side wall 25*a* adjacent to the guide groove 30, the guide blocks 34, 35 at least partially overhanging the guide groove 30 to hold the rod 31 in the vertical guide groove 30 against lateral displacement. The rod 31 is vertically movable between an uppermost position in which the feeler 32 is disposed around the punch 29, as indicated by solid lines in FIG. 2, and a lowermost position in which the feeler 32 is disposed downwardly remotely from the punch 29, as indicated by phantom lines in the same figure. The rod 31 is normally urged toward its lowermost position by a tension spring 36 acting between the elongate rod 31 and the upper frame portion 6. A stopper lever 37 is pivotably connected by a pivot pin 38 to an upper end of the elongate rod 31. The stopper lever 37 is angularly movable between a locking position in which a downwardly facing locking nose 37*a* of the stopper lever 37 is held in interlocking engagement with an upwardly facing retaining surface 39*a* of an abutment 39 secured to an upper end wall 25*b* of the ram 25, and a releasing position in which the locking nose 37*a* is disengaged from the retaining surface 39*a*. The stopper lever 37 is normally urged toward the locking position by means of a torsion spring 40 (FIGS. 2 and 4). A second selenoid 41 is mounted on the upper wall of the upper frame portion 6 and is connected to a horizontal actuation bar 42 slidably supported by a support block 43 secured to the upper wall of the upper frame portion 6. The actuating bar 42 has a flanged free end 42*a* engageable with a lateral projection 37*b* extending horizontally from a lower end of the stopper lever 37. When the second solenoid 41 is energized to pull the actuation bar 42 against the force of a compression coil spring 44, the flanged free end 42*a* of the actuation bar 42 is brought into engagement with the lateral projection 37*b* of the stopper lever 37 and then turns the stopper lever 37 clockwise in FIG. 1 against the force of the spring 40, thereby bringing the locking nose 37*a* out of engagement with the retaining surface 39*a*. When the second solenoid 41 is de-energized, the actuation bar 42 is returned to its extended position of FIG. 1 wherein the flanged free end 42*a* is held out of engagement with the lateral projection 37*b*.

A cam plate 45 is secured to an intermediate portion of the elongate rod 31 for engagement with a leaf-roller actuator 46 of a limit switch 47 secured to one of the ram guides 22, as shown in FIGS. 2 and 3. The cam plate 45 and the limit switch 47 are positioned such that while the elongate rod 31 is disposed in its lowermost position, the cam plate 45 engages the leaf-roller actuator 46. of the limit switch 47, thereby activating the limit switch 47. The limit switch 47 is electrically connected with the first solenoid 20 for energizing the latter upon activation of the limit switch 47.

Operation of the fastener assembling apparatus thus constructed is described below.

The electric motor 10 is driven to rotate the pulleys 14, 17. In this instance, the single revolution clutch 19 is de-energized so that the rotary motion of the pulley 17 is not transmitted to the main shaft 12.

Then, as shown in FIG. 2, a fastener element $E_1$, such as a retainer of a button, is held on the punch 29 and a mating fastener element $E_2$, such as a button body, is held on a die 48 mounted on the lower frame portion 7. A garment fabric F is placed on the die 48 so that a desired portion of the garment fabric F is located above the fastener element $E_2$ held on the die 48.

Thereafter, a foot switch or other suitable switching means (not shown) is actuated by the operator to energize the second solenoid 41 whereupon the actuating bar 42 is pulled toward the solenoid 41 against the force of the spring 44. This movement of the actuator bar 42 causes the flanged free end 42*a* of the actuator bar 42 to engage with the lateral projection 37*b* and then to turn the stopper lever 37 clockwise in FIG. 1 against the force of the spring 40, thereby releasing the locking nose 37*a* from the retaining surface 39*a* of the abutment 39. With the stopper lever 37 thus released, the elongate rod 31 is lowered by the force of the tension spring 36 until the rod 31 and hence the ring-like feeler 32 arrives at its lowermost position indicated by the plantom lines in FIG. 2. Upon arrival of the rod 31 and the feeler 32 at their lowermost positions, the cam plate 45 engages the leaf-roller actuator 46 of the limit switch 47 to activate the limit switch 47. The limit switch 47 in turn energizes the first solenoid 20, thereby activating the single revolution clutch 19 to connect the pulley 17 and the main shaft 12 for thereby turning the main shaft 12 through an angle of 360 degrees. This rotary motion of the main shaft 12 is converted by the pins 26, 28 and the link 27 into one cycle of vertical reciprocation of the ram 25 so that the two fastener elements $E_1$, $E_2$ are clinched together by and between the punch 29 and the die 48, with the garment fabric F sandwiched between the fastener elements $E_1$, $E_2$.

Upon completion of the clinching operation, the ram 25 moves upwardly. The upward movement of the ram 25 causes the retaining surface 39*a* of the abutment 39 to hook the locking nose 37*a* of the stopper lever 37. Thereafter, as the upward movement of the ram 25 advances, the elongate rod 31 is lifted by the ram 25 to its uppermost position against the force of the tension spring 36.

If the operator's finger, for example, is inserted into the gap between the punch 29 and the die 48, the elongate rod 31 cannot arrive at its lower position even though the foot switch is actuated. This is so because the ring-shaped feeler 32 is brought into engagement with the operator's finger before the arrival of the rod 31 at its lowermost position, thereby blocking further downward movement of the rod 31. With the rod 31 thus blocked, activation of the limit switch 47 by the cam plate 45 cannot take place, thus maintaining the first solenoid 20 in de-energized condition. In this condition, the rotating pulley 17 and the main shaft 12 still remain disengaged and therefore lowering of the ram 25 and hence the punch 29 does not take place, thus avoiding any accident could result if the operator's were finger inadvertently inserted and were hit by the punch 29.

Although various minor modifications may be suggested by those versed in the art, it should be understood that we wish to embody within the scope of the patent warranted hereon, all such embodiments as reasonably and properly come within the scope of our contribution to the art.

What is claimed is:

1. An apparatus for assembling a pair of fastener elements of a garment fastener with a garment fabric disposed therebetween, comprising:

(a) a frame;

(b) a die mounted on a lower portion of said frame for supporting thereon one of the fastener elements;

(c) a reciprocable ram mounted on an upper portion of said frame and carrying a punch in confronting relation to said die for supporting thereon the other fastener element;

(d) drive means for moving said ram and hence said punch vertically toward and away from said die to join the two fasteners together, with the garment fabric sandwiched between the fastener elements; and (e) a safety device including (1) a vertical elongate rod movably supported by said ram and having a feeler disposed adjacent to the path of movement of said punch, said rod being vertically movable between an uppermost position in which said feeler is disposed upwardly remotely from said die, and a lowermost position in which said feeler is disposed adjacent to said die, (2) first spring means urging said rod downwardly toward said lowermost position, (3) an abutment secured to said ram for reciprocation therewith, (4) a stopper lever pivotably connected to said rod and angularly movable between a locking position in which said stopper lever can be held in interlocking engagement with said abutment, and a releasing position in which said stopper lever is disengaged from said abutment, (5) second spring means urging said stopper lever toward said locking position, said abutment being lockingly engageable with said stopper lever to move the rod from the lowermost position to said uppermost position as said ram moves upwardly, (6) a first actuator for moving said stopper lever toward said releasing position against the force of said second spring means to thereby allow said rod to move toward the lowermost position under the force of said first spring means, (7) sensor means for detecting the arrival of said rod at said lowermost position, and (8) a second actuator operatively connected with said sensor means and said drive means for activating said drive means only when the arrival of said rod at said lowermost position is detected by said sensor means.

2. An apparatus according to claim 1, said feeler having a ring-like shape extending circumferentially around said punch while said rod is disposed in said uppermost position.

3. An apparatus according to claim 1, said ram including a vertical guide groove in which said rod is slidably received, and at least one guide block at least pertially overhanging said guide groove and holding said rod in said guide groove against displacement therefrom.

4. An apparatus according to claim 1, said first spring means comprising a tension spring acting between said rod and said upper frame portion.

5. An apparatus according to claim 1, said stopper lever having a downwardly facing locking nose, said abutment having an upwardly facing retaining surface engageable with said locking nose.

6. An apparatus according to claim 1, said first actuator comprising a solenoid mounted on said upper frame portion, and an actuating bar connected in driven relation to said solenoid and engageable with said stopper lever when said solenoid is energized.

7. An apparatus according to claim 6, said stopper lever having a lateral projection, said actuating bar having a flanged free end engageable with said lateral projection.

8. An apparatus according to claim 1, said sensor means comprising a limit switch, said rod including a cam plate engageable with an actuator of said limit switch to activate said limit switch while said rod is disposed in said lowermost position.

* * * * *